United States Patent [19]

Witt et al.

[11] Patent Number: 5,042,359

[45] Date of Patent: Aug. 27, 1991

[54] PROJECTILE ACCELERATING DEVICE

[75] Inventors: Wolfram Witt, Düsseldorf; Markus Löffler, Unterlüss; Ulrich Braunsberger, Broistedt; Jürgen Salge, Salzgitter, all of Fed. Rep. of Germany

[73] Assignees: Rheinmetall GmbH, Dusseldorf; TZN Forschungs- und Entwicklungszentrum GmbH, Unterlüss, both of Fed. Rep. of Germany

[21] Appl. No.: 337,048

[22] Filed: Apr. 12, 1989

[30] Foreign Application Priority Data

Apr. 28, 1988 [DE] Fed. Rep. of Germany ..... 3814322

[51] Int. Cl.[5] ..... F41B 6/00

[52] U.S. Cl. ..... 89/8; 102/375; 124/3

[58] Field of Search ..... 89/7, 8; 102/375; 124/3

[56] References Cited

U.S. PATENT DOCUMENTS

| | | | |
|---|---|---|---|
| 667,435 | 2/1901 | Friese-Green et al. | 102/375 |
| 1,349,414 | 8/1920 | Dougan | 89/5 |
| 2,899,864 | 8/1959 | Bloxsom | 89/7 |
| 2,926,566 | 3/1960 | Atkins et al. | 89/7 |
| 4,715,261 | 12/1987 | Goldstein et al. | 89/8 |
| 4,895,062 | 1/1990 | Chryssomallis et al. | 89/7 |
| 4,913,029 | 4/1990 | Tidman et al. | 89/8 |

FOREIGN PATENT DOCUMENTS

| | | | |
|---|---|---|---|
| 0242501 | 10/1987 | European Pat. Off. . | |
| 3613259 | 10/1987 | Fed. Rep. of Germany | 124/3 |
| 1013360 | 12/1965 | United Kingdom . | |

OTHER PUBLICATIONS

Webster's New World Dictionary of the American Language, College Edition, 1957, "Projectile", p. 1164.

*Primary Examiner*—Stephen C. Bentley
*Attorney, Agent, or Firm*—Spencer & Frank

[57] ABSTRACT

A device for accelerating projectiles from a muzzle of a launching tube, with an electrically heated plasma, the plasma being produced by two electrodes between which is formed an electric arc that creates and heats the plasma. To assure in a simple manner that the pressure at the projectile base is almost constant during launching of the projectile, one of the two electrodes is provided at a breechblock of the tube and the other is formed by the base of the projectile.

10 Claims, 4 Drawing Sheets

PROJECTILE ACCELERATING DEVICE

BACKGROUND OF THE INVENTION

The present invention relates to a device for accelerating projectiles by means of an electrically heated plasma. More particularly, the invention relates to such a device for accelerating projectiles, which is of the type including a launching tube which is closed at one end and in which the projectile and two two spaced electrodes for generating and heating the plasma are disposed, one of the two electrodes being disposed at the closed end of the tube.

It is known that firing devices operating according to electrothermal principles (e.g. U.S. Pat. No. 2,899,864) utilize the conversion of electromagnetic energy to thermal energy. In such firing devices, the hot plasma required to drive the projectile is generated and heated by means of an electric arc combusting the plasma between fixed electrodes. The fixed electrodes are here either disposed on the closed (breechblock) end of the launching tube or are distributed over the length of the tube.

In the case where the electrodes are arranged at the breechblock end, the gas pressure generated at the base of the projectile very quickly takes on a high value which is limited by the strength characteristics of the arc burning chamber, the tube and the projectile. However, during acceleration of the projectile, this pressure quickly decreases because of the flow processes taking place in the tube. In this case, the velocity of the projectile at the open end (muzzle) of the tube is noticeably less than would be possible for acceleration with constant pressure.

If the electrodes are distributed over the length of the tube, this drawback does not occur. In that case, the pressure at the projectile base can be kept almost constant by the controlled and continuous addition of electrical discharges and the resulting evaporation of material immediately behind the projectile. However, such an arrangement requires a multicomponent tube and has the drawback that the expenditures for the tube, and for the energy supply, are extremely high.

SUMMARY OF THE INVENTION

It is therefore an object of the present invention to provide a device of the above-mentioned type which has a simple structure and makes it possible to keep the pressure at the projectile base almost constant.

This is achieved by the present invention in that in a device for accelerating a projectile which is disposed in a launching tube which is closed at one end, the projectile is accelerated by means of an electrically heated plasma and two electrodes between which is generated an electric arc which heats the plasma, with one of the two electrodes being disposed at the closed (breechblock) end of the tube and the base of the projectile forming the other of the two electrodes.

BRIEF DESCRIPTION OF THE DRAWINGS

These and further details and advantages of the invention can be more fully understood from the following detailed description of the preferred embodiments with reference to the drawing figures in which.

DETAILED DESCRIPTION OF THE PREFERRED EMBODIMENT

Figure 1:
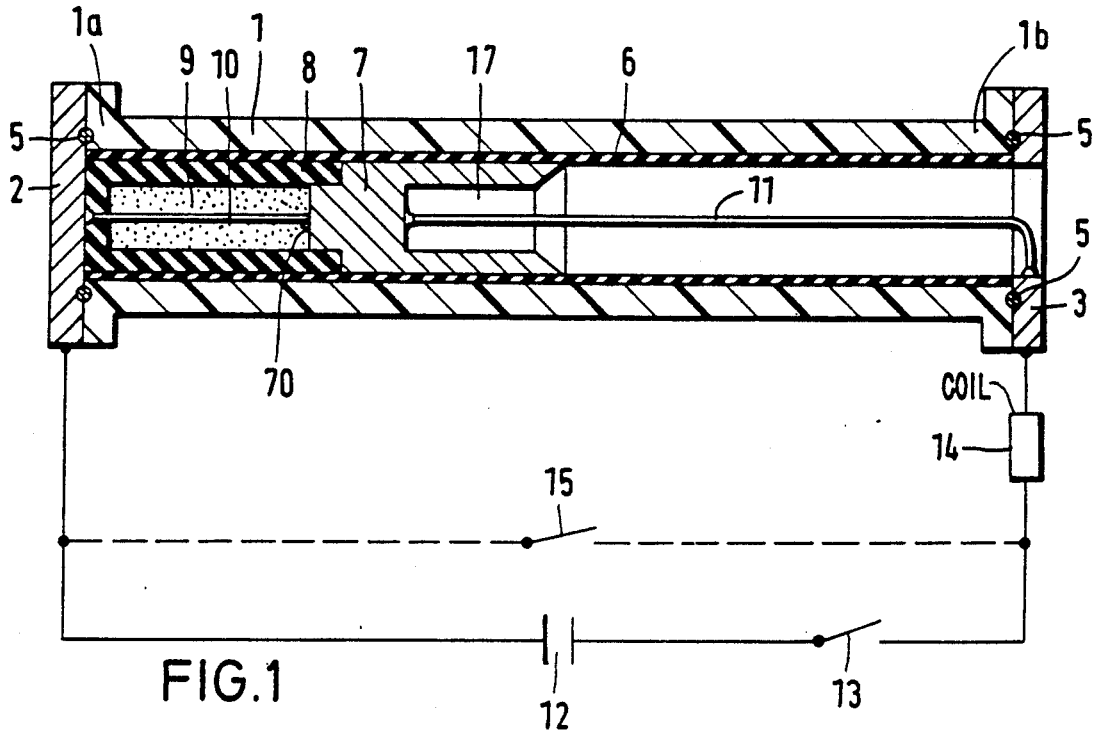
FIG. 1 is a partially schematic and partially cross-sectional view of one embodiment of an electrothermal firing device according to the invention.
Figure 2:
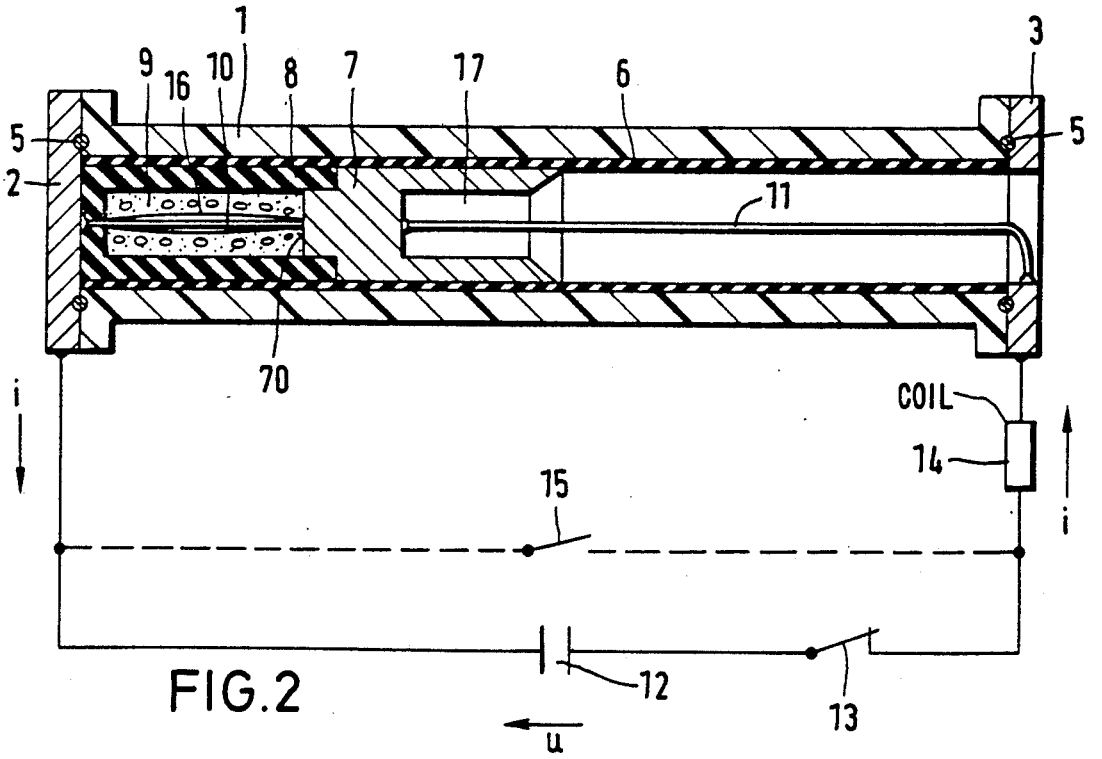
FIG. 2 is a partially schematic and partially cross-sectional view of the embodiment of FIG. 1 at the beginning of acceleration of the projectile.
Figure 3:
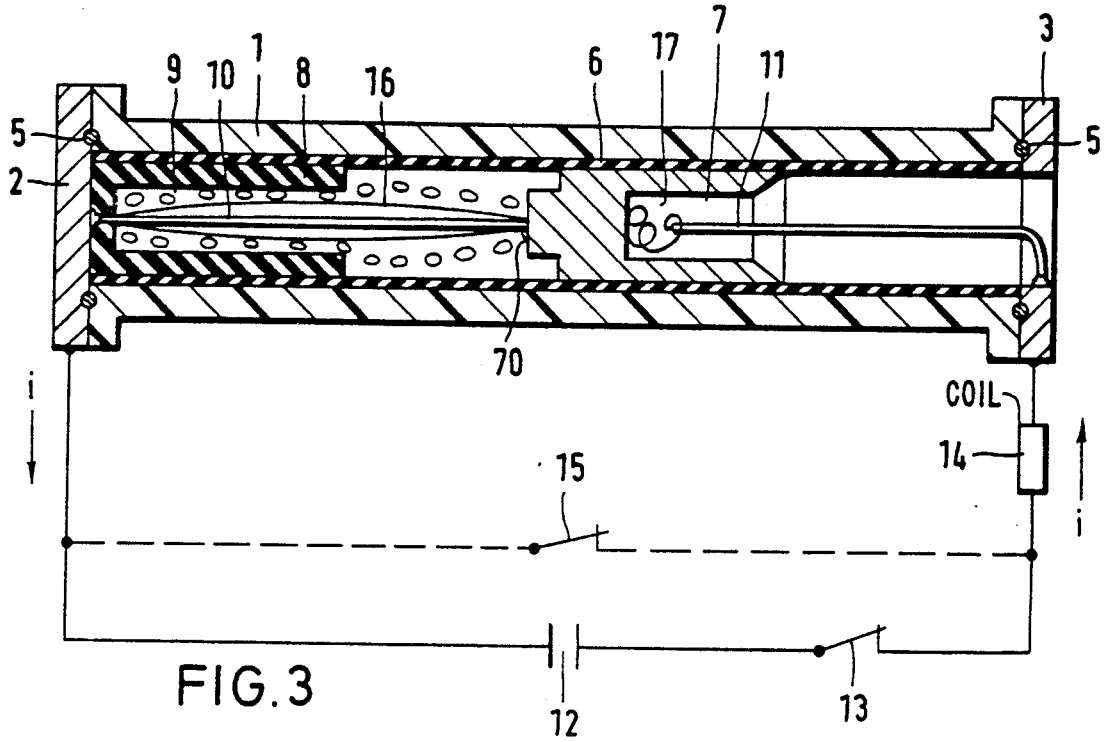
FIG. 3 is a partially schematic and partially cross-sectional view of the acceleration device of FIG. 1 at a later time in the projectile acceleration process.

FIGS. 1 to 3 show the principle of operation of the electrothermal firing device according to the invention. The firing device is composed of a launching tube 1 having a closed breech end and an open muzzle end, (about 4 meters in length and having a caliber of 50 mm), made of high mechanical strength material such as fiberglass-reinforced plastic which is a poor electric conductor, and an electrode 2 forming the breechblock at the end of the breech of the tube, as well as an annular contact 3 at the end of the muzzle 1*b*. Electrode 2 and contact 3 are flanged to tube 1 by means of screw connections (not shown) and press onto sealing rings 5. Tube 1 is provided at its inner surface with an exchangeable tube 6 of insulating material.

A cup-shaped projectile 7 made of an electrically conductive material is disposed within tube 1 and has a base 70 facing the breech 1*a*. In the breech between the electrode 2 and the projectile 7, an electrically non-conductive casing 8 filled with a poorly electrically conducting liquid or powdered material 9 rich in hydrogen, such as water, oil, lithium hydride or polyethylene powder is provided so as to produce when ignited a gas having a low molecular weight. The casing 8 is attached to the base 70 of the projectile 7.

A thin electrically conductive wire 10 made for example of aluminum or lithium and having a diameter of 1/5 mm, electrically connects the base 70 of the projectile 7 with the electrode 2. The base 70 functions as an electrode, as described below.

The projectile 7 is electrically connected with contact 3 by means of an electrically conductive wire 11 which is made for example of copper and having a diameter of 2.5 mm which is of sufficient thickness that it is not consumed by current therethrough during the acceleration process and which is fastened to the bottom of a cup-shaped recess 17 in projectile 7. Electrode 2 and contact 3 are connected in series to an energy supply composed of a voltage source 12 having capacitive characteristics, an actuator switch 13 and a coil 14, and to a short-circuit switch 15 in parallel with the voltage source 12 and switch 13. As will be described below, short-circuit switch 15 may be omitted under certain conditions.

FIG. 2 shows the arrangement at the beginning of the acceleration process. Upon closing of switch 13, voltage source 12 which is charged to a voltage u drives a high current i (e.g. 50 kA) through coil 14, contact 3, wire 11, projectile 7, wire 10 and electrode 2. This causes the thin wire 10 to be heated quickly so that it finally evaporates and an arc 16 is generated between electrode 2 and projectile base 70 (which serves as an electrode) heating the filler material 9 and evaporating it. The pressure generated thereby drives projectile 7 in the direction of annular contact 3 at the muzzle 1*b*.

FIG. 3 shows the arrangement at a later point in time of the acceleration process. After the current i has reached its maximum, short-circuit switch 15 is closed so that the current is now driven through the arrangement by coil 14 and the electromagnetic energy is no longer able to flow back into the capacitive voltage source 12.

Closing of a short-circuit switch 15 may be omitted if the amount of electromagnetic energy removed from the circuit by the electric arc intensively cooled by the plasma, is so great that the electromagnetic energy has already been consumed before it is able to swing back to the capacitive voltage source.

The arc 16 burning between the base 70 of projectile 7 and electrode 2 continues to heat the evaporated filler material 9 and thus adapts its length to the acceleration path traversed by the projectile. Material from insulating tube 6 is also evaporated. During this time, the volume of gas behind projectile 7 is heated continuously over its entire length and thus the gas pressure is kept almost constant in space and in time over the entire gas volume. The wire 11 in front of projectile 7 is caught in the cupshaped recess 17 in the projectile 7 and is sheared off when the projectile 7 leaves the tube 1.

Corresponding projectiles 7 having a mass between 200 and 300 g are able to attain muzzle velocities between 3 and 4 km/s.

Figure 4A:
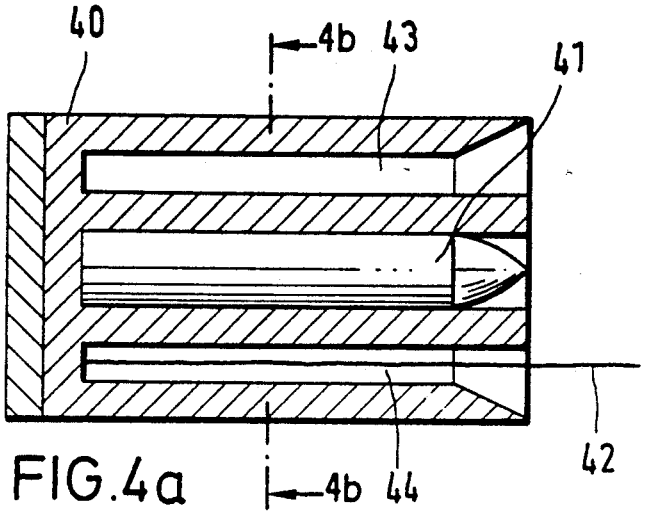
FIGS. 4*a* and 4*b* are different cross-sectional views of an embodiment of a projectile equipped with a wire catching device.
Figure 4B:
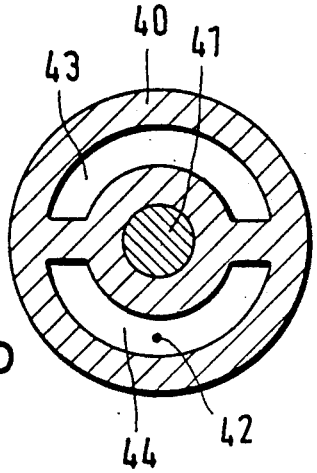

To prevent the positional stability of the projectile after it leaves the muzzle, from being influenced by the shearing away of the wire and the relatively high air resistance of the cup-shaped projectile, the projectile may be accelerated in practice—as shown in FIGS. 4*a* and 4*b* —with the aid of a sabot 40.

In the illustrated embodiment, sabot 40 is composed of two halves which fold open once the projectile has left the muzzle and release a projectile 41 which has an aerodynamically favorable configuration. During the acceleration process, wire 42 is collected in one of the two chambers 43 and 44 of sabot 40. To prevent wire 42 from shearing off, it may be given such dimensions that it evaporates in the manner of an explosion immediately before leaving the muzzle.

To avoid having to connect wire 42 manually with the muzzle contact 3 before each shot (see FIG. 1), wire 42 may also be fired from the projectile to the muzzle electrode by means of a small firing device as described with reference to FIG. 5 below. To avoid having to catch the wire during each acceleration process, it may also be designed in such a manner that it will evaporate immediately after initiation of the acceleration process and be replaced by a conductive plasma.

Figure 5:
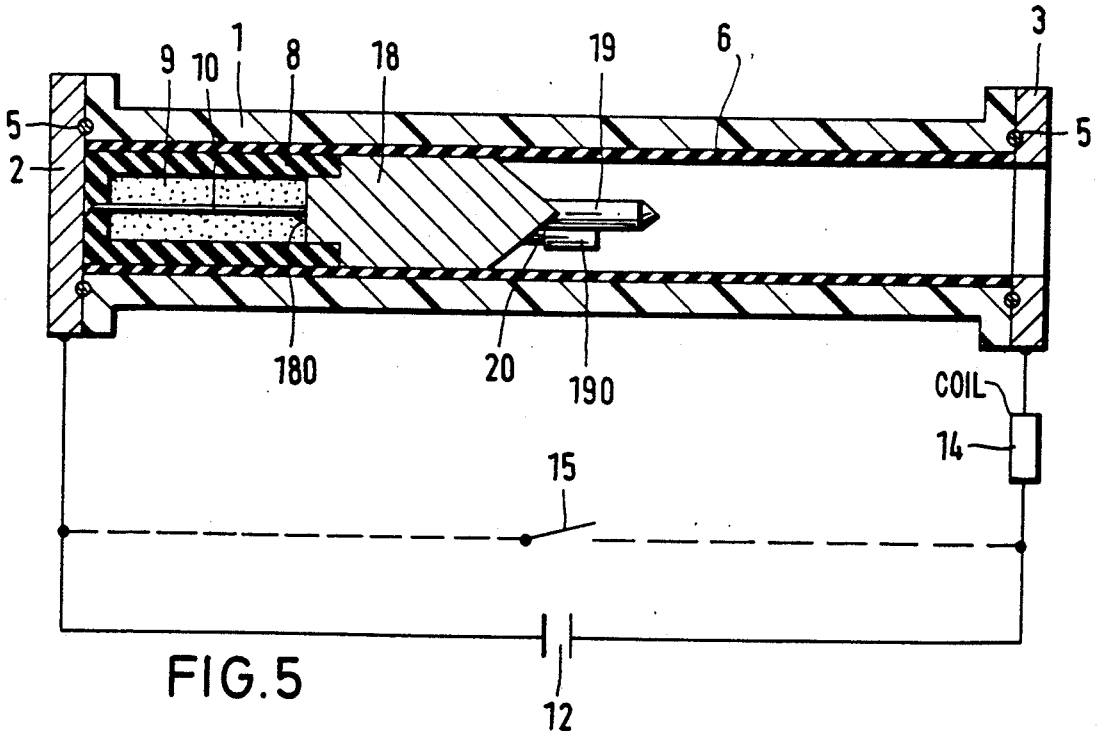
FIG. 5 is a partially schematic and partially cross-sectional view of a further embodiment of an electrothermal firing device according to the invention.

An example of the above-mentioned small firing device is shown in FIG. 5. This arrangement differs from the preceding one in that a projectile 18 to be accelerated is provided with a tapered tip rather than a recess, and a small rocket 19 is attached to this tapered tip. The projectile is similarly to the prior embodiment arranged with its base 180 against the open end of the casing 8 and a wire extending through the material and the rear of the casing 8 to the electrode 2. A small quantity of propelling charge powder is disposed in the interior of rocket 19. A container 190 in which wire 20 is disposed is attached to rocket 19.

To initiate the acceleration of projectile 7, the small rocket 19 is fired toward muzzle electrode 3 by igniting the propelling charge powder using, for example, an electrical ignition device (not shown in FIG. 5). The rocket reaches a velocity of, for example, 10 m/s.

Figure 6:
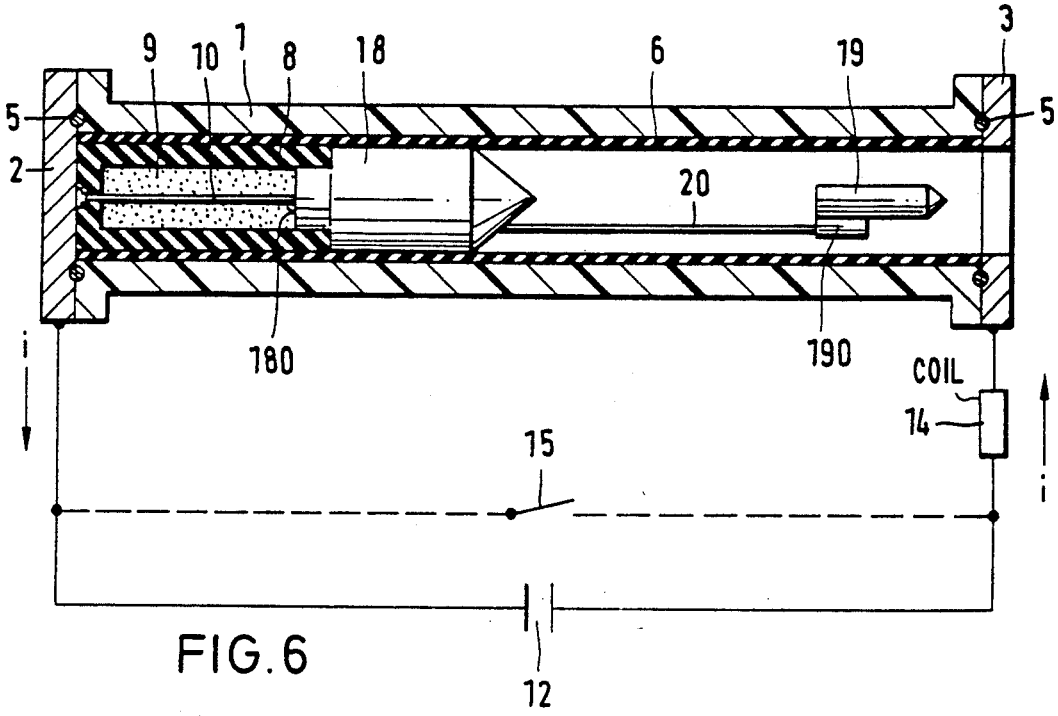
FIGS. 6 and 7 are partially schematic and partially cross-sectional views of the firing device of FIG. 5 at two different points in time.
Figure 7:
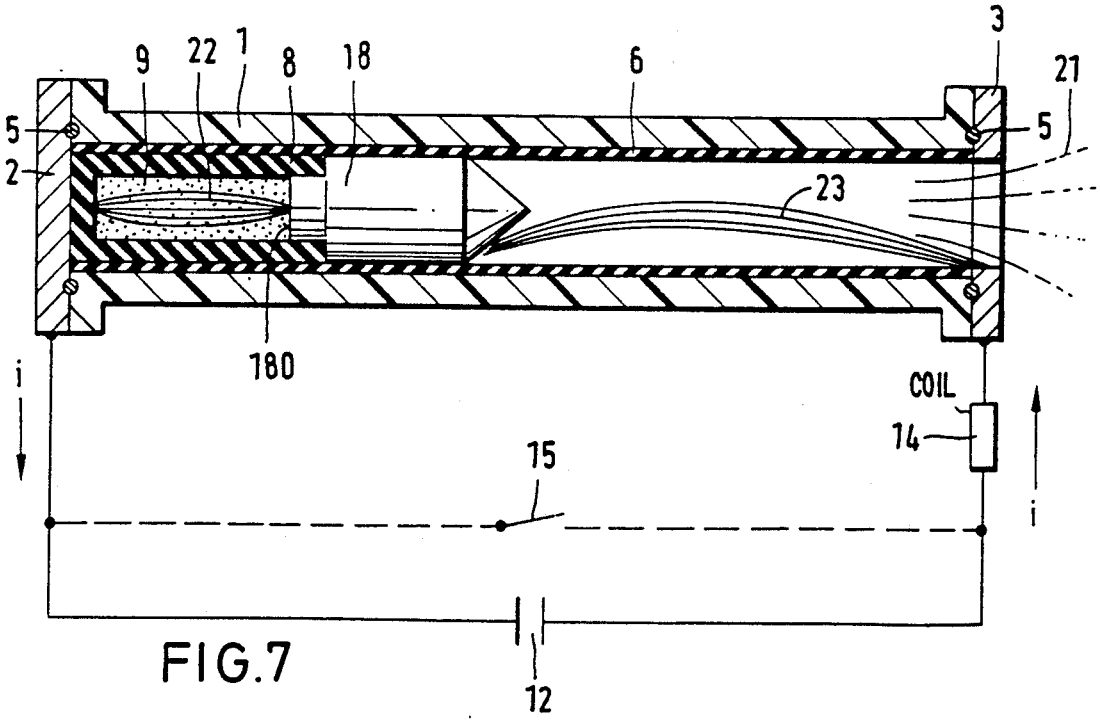

This causes wire 20 to be pulled from projectile 18 toward muzzle contact 3 (see FIGS. 6 and 7). Once the small rocket 19 has left the muzzle 1 and disconnected from wire 20, and wire 20 has reached and contacted muzzle contact 3, a flow of current i is initiated through voltage source 12, coil 14, wire 20, projectile 18, wire 10 and electrode 2. The quickly rising current i causes the two wires 10 and 20 to be rapidly heated and finally to evaporate. The arcs 22 and 23 shown in FIG. 7 are produced between breechblock electrode 2 and projectile 18 and between projectile 18 and muzzle contact 3, respectively, the former causing evaporation of the filler material 9. The pressure in the space between projectile 18 and breechblock electrode 2 is considerably higher than between projectile 18 and muzzle contact 3 since the heated gas present in the gas volume ahead of the projectile is able to escape from the tube. Thus, projectile 18 is accelerated in the direction toward the muzzle.

The energy present in electromagnetic form is also coupled into tube 1 primarily in the gas volume between projectile 18 and electrode 2 since arc 22 is cooled extensively by the filler material 9 and thus the ohmic resistance of this arc is considerably greater than the ohmic resistance of arc 23 between projectile 18 and muzzle electrode 3.

The present disclosure relates to the subject matter disclosed in Federal Republic of Germany patent application no. P 38 14 332.1 of Apr. 28th, 1988, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A projectile accelerating device, comprising:

an axially extending launching tube having a closed first end and an open second end;

a first electrode in said tube at said first end;

a projectile to be accelerated, having a base which includes a second electrode, said projectile being disposed in said tube at an initial position between said first and second ends with said second electrode forward of and axially spaced from said first electrode, leaving a space between said first and second electrodes for a plasma; and means for generating and maintaining an electric current forming an electric arm between said first and second electrodes to heat the plasma during a movement of said projectile from said initial position to said open end of said tube, so as to exert a continuous pressure on said projectile in order to accelerate said projectile continuously during the movement, toward said open end of said tube, said means for generating an electric arm further comprising a first electrically conductive wire for electrically connecting said second end to said base of said projectile so as to carry the current during passage of the projectile through the launching tube, until the projectile leaves the launching tube and detaches from said first wire, said first wire being noncunsumable by the current, said projectile having a cup-shaped recess in a forward end thereof for catching said first wire during the acceleration of said projectile.

2. A projectile accelerating device as in claim 1, wherein said means for generating an electric arc comprises a second electrically conductive wire extending axially through said space to connect said first and second electrodes.

3. A projectile accelerating device as in claim 1, further comprising a casing formed of an electrically nonconductive material and filled with an electrically poorly conductive material having a high hydrogen content in the form of one of a powder and a liquid, said casing being located in said space with said projectile disposed thereon.

4. A projectile accelerating device as in claim 3, wherein said material consists of a material selected from the group consisting of water, oil, lithium hydride and polyethylene powder.

5. A projectile accelerating device comprising:

an axially extending launching tube having a closed first end and an open second end, said second end forming a muzzle, an annular contact at said muzzle, a first electrode in said tube at said first end;

a projectile to be accelerated, having a base which includes a second electrode, said projectile being disposed in said tube with said second electrode forward of and axially spaced from said first electrode, leaving a space between said first and second electrodes for a plasma, and means, including a first electrically conductive wire electrically connected to said contact and said base of said projectile, for generating a current forming an electric arc between said first and second electrodes to heat the plasma so as to exert a pressure on said projectile in order to accelerate said projectile toward said open end of said tube, said first wire carrying the current therethrough during passage of the projectile through said launching tube until the projectile leaves said launching tube and detaches from said first wire, said first wire being nonconsumable by the current.

6. A projectile accelerating device as in claim 5, wherein said means for generating an electric arm comprises a second electrically conductive wire extending axially through said space to connect said first and second electrodes.

7. A projectile accelerating device, comprising:

an axially extending launching tube having a closed first end and an open second end, said second end forming a muzzle, a contact at said muzzle, a first electrode in said tube at said first end;

a projectile to be accelerated, having a base which includes a second electrode, said projectile being disposed in said tube with said second electrode forward of and axially spaced from said first electrode, leaving a space between said first and second electrodes for a plasma, and means, includes a first electrically conductive wire electrically connected to said contact and said base of said projectile, for generating a current forming an electric arc between said first and second electrodes to heat the plasma so as to exert a pressure on said projectile in order to accelerate said projectile toward said open end of said tube, said first wire carrying the current therethrough during passage of the projectile through said launching tube until the projectile leaves said launching tube and detaches from said first wire, said first wire being nonconsumable by the current, wherein said projectile has a cup-shaped recess in a forward end thereof for catching said first wire during the acceleration of said projectile.

8. A projectile accelerating device as in claim 7, wherein said means for generating an electric arc comprises a second electrically conductive wire extending axially through said space to connect said first and second electrodes.

9. A projectile accelerating device, comprising an axially extending launching tube having a closed first end and an open second end, a first electrode in said tube at said first end, a projectile to be accelerated, having a base which includes a second electrode, said projectile being disposed in said tube with said second electrode forward of and axially spaced from said first electrode, leaving a space between said first and second electrodes for a plasma, means for generating an electric arc between said first and second electrodes to heat the plasma so as to exert a pressure on said projectile in order to accelerate said projectile toward said open end of said tube, a small rocket releasably mounted on a nose section of said projectile, a container on said rocket, and an electrically conductive wire in said container and connecting said projectile and said rocket such that firing of said rocket toward said open end releases said rocket from said projectile and plays out said wire from said projectile to said open end of said tube.

10. A projectile accelerating device, comprising:

an axially extending launching tube having a closed first end and an open second end, said second end forming a muzzle, a contact at said muzzle, a first electrode in said tube at said first end, a projectile to be accelerated, having a base which includes a second electrode, said projectile being disposed in said tube with said second electrode forward of and axially spaced from said first electrode, leaving a space between said first and second electrodes for a plasma, and means for generating an electric arc between said first and second electrodes to heat the plasma so as to exert a pressure on said projectile in order to accelerate said projectile toward said open end of said tube, said means for generating an electric arc including a small rocket releasably mounted on a nose section of said projectile, a container on said rocket, and an electrically conductive wire in said container and connecting said projectile and said rocket such that firing of said rocket toward said open end releases said rocket from said projectile and plays out said wire from said projectile to said muzzle of said tube into electrical contact with said contact.

* * * * *